United States Patent [19]

Erickson

[11] 4,299,352

[45] Nov. 10, 1981

[54] CENTRIFUGE APPARATUS

[75] Inventor: John W. Erickson, Huntington Beach, Calif.

[73] Assignee: Kobe, Inc., Commerce, Calif.

[21] Appl. No.: 23,204

[22] Filed: Mar. 23, 1979

[51] Int. Cl.[3] ..... B04B 1/00

[52] U.S. Cl. ..... 233/3; 233/1 D

[58] Field of Search ..... 233/3, 6, 7, 8, 9, 10, 233/12, 14 R, 14 A, 1 D, 1 R; 366/175, 174, 170, 169

[56] References Cited

U.S. PATENT DOCUMENTS

| | | | |
|---|---|---|---|
| 3,228,594 | 1/1966 | Amero | 233/7 |
| 3,302,873 | 2/1967 | Kowata | 233/7 |
| 3,322,336 | 5/1967 | Lohse | 233/7 |
| 3,423,015 | 1/1969 | O'Conor | 233/7 |

*Primary Examiner*—Robert W. Jenkins

*Attorney, Agent, or Firm*—William C. Norvell, Jr.

[57] ABSTRACT

A centrifuge apparatus for separating materials of different densities having means for the removal of the more dense materials utilizing a jet of pressure fluid to assist in moving the more dense materials to an appropriate outlet from the apparatus.

6 Claims, 3 Drawing Figures

CENTRIFUGE APPARATUS

BACKGROUND OF THE INVENTION

1. Field of the Invention

The invention relates to apparatus for separating materials of different densities such as liquids and solids, and more particularly to a centrifuge apparatus for concentrating the solids fraction of a solids-liquid slurry, for example, wherein the concentrated solids fraction is moved to an outlet therefor by means of pressure fluid.

2. Description of the Prior Art

In the broad field of solids-liquid separation, centrifugal separation is a typical mechanical method for achieving the desired objective in an efficient manner. The separation is achieved by apparatus wherein the solids fraction is continuously separated from the liquid fraction of a solids-liquid slurry being treated by the application of high centrifugal force. The slurry is initially introduced into a revolving metallic bowl of a centrifuge through a stationary feed tube at the center of rotation of the apparatus. In operation, the slurry is then acted upon by centrifugal separating forces which often times approaches 3,000 times the force of gravity. The solids are thereby caused to be forced outwardly against the wall of the rotating bowl. Manifestly, the liquid, being of lesser density, forms a concentrated inner layer in the rotating bowl. It will be appreciated that the suspended particles or solids which are more dense than the suspending liquid tend to migrate toward the periphery. The rapidity with which this migration proceeds is dependent upon the intensity of the centrifugal force, the difference between the density of the particle and that of the suspending fluid, the viscosity of the liquid, the size and shape of the particle, and to some extent, the concentration of the particles and the degree to which they are electrically charged. A practically complete separation of the suspending medium and the suspended phase can be produced if the centrifugation is allowed to continue until all particles have collected against the outer wall of the rotating bowl. A partial separation of two groups of suspended particles of different size can be affected by allowing centrifugation to continue, only long enough for all the larger particles to be completely packed into the sediment, since then many of the small particles will still be suspended in the fluid. If purification of the larger, as well as the smaller particles is desired, the supernatant fluid can be drawn off and the sediment resuspended in some suitable liquid and subsequently centrifuged again to effect a further separation. This process may be repeated any number of times.

Finally, the concentrated mass of solids is continuously caused to be removed by a screw conveyor action inside of the rotating bowl. This action is accomplished by a helical metal screw which rotates in the same direction, but at a slightly different speed than that of the bowl. The screw functions as a mechanical conveyor designed so that the solids deposited against the inner wall of the bowl are moved to one end thereof, where they are scraped up and out of the liquid layer. The solids are discharged from the bowl through suitably located outlets which lead to a desired receiving chamber.

The clarified liquid is simultaneously continuously removed as its overflows an adjustable weir at the liquid discharge end of the bowl, which is in communication with suitable discharge casing to conduct the liquid away.

Since the solids are typically abrasive in nature, it will be appreciated that they will have a rather deleterious effect on the wearing properties of the screw conveyor and the inner wall of the associated bowl adversely affecting the separating efficiency and the life cycle of the overall centrifuge apparatus.

SUMMARY OF THE INVENTION

It is an object of the present invention to produce a centrifuge apparatus for separating liquids and solids from a solids-liquid slurry, wherein the concentrated solids are moved to an outlet by a jet of pressure fluid.

It is another object of the invention to produce a centrifuge apparatus capable of moving a concentrated zone of solids of a solids-liquid slurry to an outlet by an array of fluid jets.

Another object of the invention is to produce a centrifuge apparatus for moving a concentrated zone of solids of a solids-liquid slurry without mechanical contact with the solids.

Still another object of the invention is to produce a method of separating the solids fraction from the liquid fraction of a solids-liquid slurry by the application of a jet stream of fluid from a high pressure source.

The above, as well as other objects of the invention, may typically be achieved by a method of separating solids from a solids-liquid slurry by subjecting the slurry to centrifugal force to effect a concentrated zone of solids and directing a jet of pressure fluids through the concentrated zone of solids to separate the solids fraction from the liquid fraction of the slurry.

The method may be achieved by an apparatus comprising a housing having inlet means for a solids-liquid slurry to be treated and separate outlet means for the solids and the liquid of the slurry; means rotating the housing to effect a concentrated zone of solids within the housing; and pressure fluid directing means for moving the concentrated solids to a solids outlet means of the housing.

DESCRIPTION OF THE PREFERRED EMBODIMENTS

Figure 1:
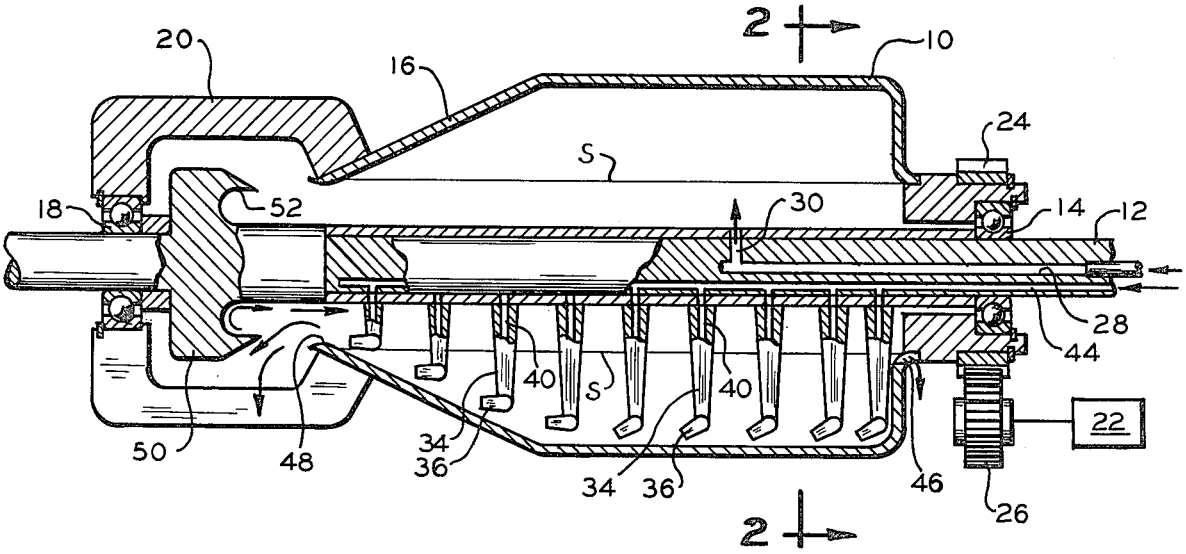
FIG. 1 is an elevational sectional view of a centrifuge apparatus embodying the features of the invention.
Figure 2:
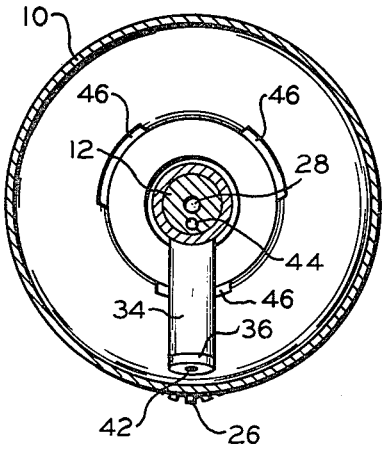
FIG. 2 is a sectional view of the apparatus illustrated in FIG. 1 taken along line 2—2 thereof.
Figure 3:
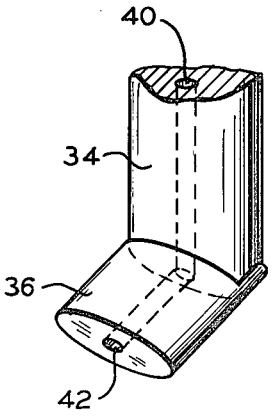
FIG. 3 is an enlarged fragmentary perspective view of the adjusting jets for directing pressure fluid within the rotating housing of the apparatus.

Referring to FIG. 1, there is illustrated a centrifuge apparatus including an outer housing or bowl 10 mounted for rotation about a relatively stationary shaft 12. One end of the housing 10 is rotatably mounted on the shaft 12 by a suitable bearing 14. The opposite end of the housing 10 includes an inwardly tapering wall portion 16 which is rotatably supported on the shaft 12 by a suitable bearing 18 interconnected to the housing by an array of arms 20. The bearings 14 and 18 typically are well suited to relatively high speeds to which the centrifuge apparatus is exposed.

The housing 10 is drivingly connected to a drive motor 22 by means of a gear 24 intergal with the housing 10 and an associated driving gear 26 coupled to the drive motor.

The shaft 12 is provided with a central bore or passageway 28, which is typically in communication with the source of slurry to be treated. The passageway 28 terminates intermediate the ends of the shaft 12 in a port 30 capable of directing the slurry to be treated and introducing the same into the interior of the housing 10.

The shaft 12 is also provided with another internal passageway 44 which extends substantially the entire internal length of the shaft 12 and generally co-axial with and separated from the passageway 28.

An elongate array of radially extending struts 34 are mounted along the outer peripheral wall of the shaft 12. The struts 34 and the associated vanes 36 are provided with communicating internal passageways 40 and 42, respectively. The struts 34 and the vanes 36 are to be designed such that the internal passageways 40 and 42 are in communication. The inlet ends of the passageways 40 are in communication with a source of pressure fluid, not shown, through the passageway 44 formed in the shaft 12. The passageways 28 and 44 in the shaft 12 are spaced and separated from one another, as will be readily apparent from an examination of FIG. 1.

It will also be noted that in the preferred embodiment, the struts 34 and the vanes 36 are streamlined in staggered cross-section to minimize any undesired currents in the associated slurry and a zone of concentrated solids during the operation of the apparatus, as will be explained in greater detail hereinafter.

The housing 10 is formed to include a clarified liquid outlet 46 at one end thereof, and a solid outlet 48 at the opposite end thereof.

A deflector element 50 is mounted on the shaft 12 adjacent the solid outlet 48 of the housing 10. The deflector element 50 is provided with an annular channel 52 of generally U-shaped cross-section, which is effective to redirect and return any lighter portion of the slurry being treated back into the interior of the housing. The specific operational aspects will be explained in greater detail hereinafter.

OPERATION

The housing or bowl 10 is initially caused to be rotated about the shaft 12 by the drive motor 22, which is typically an electric motor, at a rotational speed determined by the material being treated. The material being treated, which may be typically considered as a liquid-solid mixture of slurry, is introduced into the interior of the rotating housing 10 through the passageway 28 and its associated inlet port 30. The particles or solids fraction of the slurry, which are more dense than the liquid fraction, tend to migrate toward the periphery of the bowl 10. The rapidity with which this migration proceeds is dependent upon the intensity of the centrifugal force of the apparatus, the difference between the density of the particle fraction and that of the liquid fraction, the viscosity of the liquid, the size and shape of the solids or particles, and to some extent, the concentration of the solids and the degree to which they may be electrically charged. The net motivating force exerted on the solids fraction of the mixture is the difference between the centrifugal force acting on it and the opposing buoyancy of the liquid, the buoyancy being equivalent to the centrifugal force acting on the volume of liquid displaced by the solid fraction. It will be appreciated that in general the force of gravity is so small in comparison with the centrifugal force generated during the operation, that its effect may be neglected in the present discussion of the operational principles.

In the centrifugal field of force, the liquid fraction tries to distribute itself as far as possible from the axis of rotation, filling the outer portions of the housing and forming a free surface, which is everywhere equidistant from the axis, and hence substantially cylindrical in shape. Since the slurry being treated is continuously introduced into the rotating housing or bowl 10, the free surface of the liquid is formed generally along the line indicated in FIG. 1 by the letter S and the particle or solid fraction is concentrated adjacent the inner peripheral wall of the bowl or housing 10.

It will be noted that as the slurry is introduced into the housing 10 and the solids fraction is separated from the liquid fraction, the clarified liquid fraction is able to overflow through the outlet 46 to a suitable collector (not shown). Simultaneously, a pressure fluid, such as water, is introduced through the passageway 44 and thence the passageways 40 and 42 of the struts 34 and vanes 36, respectively. The pressure fluid is thence caused to exit through the ends of the jets or nozzles at the outlet ends of the passageways 42 of the vanes 36.

Thus, the directed pressure fluid causes the solid fraction, which has been collected adjacent the inner peripheral surfaces of the rotating bowl or housing 10 to move along the inner wall thereof, and up the inclined inner wall or ramp of the portion 16 to the solids outlet 48. The solids fraction will thence be continuously discharged through the solids outlet 48 into an associated collector (not shown). It will be appreciated that in this fashion the solids fraction may be removed from the rotating housing 10 in an effective manner obviating the necessity of the utilization of a mechanical means for forcing the solids fraction to the outlet 48. Clearly, the structure will experience considerably longer life cycles than the scroll type centrifuge apparatus with the resultant increased operating efficiency.

The deflector element 50 functions to redirect any of the lighter fractions of the slurry being treated. More specifically, the lighter fractions are caused to be directed toward the annular channel 52 wherein they are redirected back into the interior of the rotating housing 10.

It will be appreciated with the above-described arrangement, that the "light" fraction (liquid) and the "heavy" fraction (solids) can be continuously collected at opposing ends of the rotating housing 10.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centrifuge apparatus for separating solids from a solid-liquid slurry comprising: a rotatable housing having a concentric outer wall and inlet means for the solid-liquid slurry to be treated; separate outlet means in said housing for the solid fraction and the liquid fraction of the slurry after separation; the outlet means for solids being axially spaced relative to the inlet means for the solid-liquid slurry; means for rotating said housing to effect a concentrated zone of solids adjacent the inner surface of said outer wall of said housing; and pressurized fluid directing means for moving the concentrated solids axially along said outer wall to said solid outlet means of said housing, said pressurized fluid directing means being the primary means for axially moving the concentrated solids.

2. The invention defined in claim 1 wherein said housing rotates around a central shaft, and said fluid pressure directing means includes at least one strut member extending radially from said shaft towards said outer wall and having an internal passageway in communication with a source of pressure fluid and a discharge port directed to supply said pressure fluid axially along the inner surface of said outer wall.

3. The invention defined in claim 1 wherein said housing rotates around a central shaft, and said pressurized fluid directing means comprises a plurality of radially extending struts disposed in axially and peripherally spaced relation within said housing, each said strut having an internal passageway in communication with a source of pressure fluid and a discharge port directed to supply said pressure fluid axially along the inner surface of said outer wall.

4. The invention defined in claim 1, 2 or 3 wherein said outlet means for the solids is disposed at one axial end of said housing and said outlet means for the liquid is disposed at the opposite end of said axial housing.

5. The invention defined in claim 1, 2 or 3 including deflector means adjacent said solids outlet means of said housing for deflecting lighter fractions of the slurry into the interior portion of said housing.

6. A method of separating solids from a solid-liquid slurry including: subjecting the solid-liquid slurry to centrifugal force in a rotating housing to produce a concentrated zone of solids adjacent the inner wall of the rotating housing; moving the concentrated solids axially along the inner wall of the rotating housing solely by directing a jet of pressured fluid thereon, and removing the concentrated solids from one axial end of the rotating housing.

* * * * *